US009546793B2

(12) United States Patent
Green et al.

(10) Patent No.: US 9,546,793 B2
(45) Date of Patent: Jan. 17, 2017

(54) RADIANT HEATER AND COMBUSTION CHAMBER

(71) Applicant: Finn Green Technology LLC, Peoria, IL (US)

(72) Inventors: Jeffrey Green, Peoria, IL (US); David S. Finn, Peoria, IL (US)

(73) Assignee: FINN GREEN TECHNOLOGY LLC, Peoria, IL (US)

( * ) Notice: Subject to any disclaimer, the term of this patent is extended or adjusted under 35 U.S.C. 154(b) by 215 days.

(21) Appl. No.: 13/938,379

(22) Filed: Jul. 10, 2013

(65) Prior Publication Data

US 2015/0013668 A1 Jan. 15, 2015

(51) Int. Cl.
*F24D 5/08* (2006.01)
*F23C 3/00* (2006.01)

(52) U.S. Cl.
CPC ..... *F24D 5/08* (2013.01); *F23C 3/002* (2013.01)

(58) Field of Classification Search
CPC ..... F23D 14/12; F23D 14/125; F23D 14/14; F23D 14/145; F23D 14/16; F23D 14/18; F24D 5/06; F24D 5/08; F24C 3/04; F24C 3/042; F24C 3/045; F24C 3/06; F24C 3/062; F24C 3/065; F24H 3/006; F24H 3/065; F23M 9/06
USPC ..... 126/91 A, 91 R; 165/133, 183
See application file for complete search history.

(56) References Cited

U.S. PATENT DOCUMENTS 1,694,393 A * 12/1928 Nash et al. ..... 110/295
1,778,292 A * 10/1930 Donahue ..... C22B 30/06 75/705
1,870,640 A * 8/1932 Nash et al. ..... 196/116
2,075,863 A * 4/1937 Nash ..... 122/356
2,193,403 A * 3/1940 Gibbs et al. ..... 432/71
2,856,905 A * 10/1958 Bowen, III ..... 122/236
2,946,510 A * 7/1960 Galvin ..... 237/70
3,128,756 A * 4/1964 Galvin ..... 126/116 R
3,262,494 A * 7/1966 Smith, Jr. ..... F28D 1/0477 122/355
3,351,048 A * 11/1967 Fannon, Jr. ..... F23C 99/00 126/92 B
3,963,018 A * 6/1976 Schultz ..... F24C 5/08 126/91 A
3,980,069 A * 9/1976 Butlak ..... F24C 3/062 110/309
4,220,132 A * 9/1980 Streisel ..... 126/271.2 R
4,319,125 A 3/1982 Prince
4,391,323 A 7/1983 Schnier
4,422,573 A * 12/1983 Morgan ..... F24D 5/08 126/91 A
4,727,854 A 3/1988 Johnson
4,770,233 A * 9/1988 Hansen ..... A01G 9/245 165/135

(Continued)

*Primary Examiner* — Avinash Savani
*Assistant Examiner* — Deepak Deean
(74) *Attorney, Agent, or Firm* — Jackson Walker LLP

(57) ABSTRACT

An improved radiant heater and combustion chamber for use with radiant heating are described. The combustion chamber is made up of two different materials in different regions, an insulating portion and a conductive portion. Heat transfer is maximized through the conductive portion, whose shape can be altered to modify the radiant energy being emitted. The improved radiant heater radiates substantial amounts of heat in useful directions over large distances without the use of reflectors.

19 Claims, 2 Drawing Sheets

(56) References Cited

U.S. PATENT DOCUMENTS

| | | | | |
|---|---|---|---|---|
| 4,798,192 | A * | 1/1989 | Maruko | F24C 1/10 126/91 A |
| 4,869,230 | A | 9/1989 | Fletcher et al. | |
| 5,044,353 | A * | 9/1991 | Mizuno | F24C 5/08 126/91 A |
| 5,220,957 | A | 6/1993 | Hance | |
| 5,429,112 | A | 7/1995 | Rozzi | |
| 5,626,125 | A | 5/1997 | Eaves | |
| 6,027,333 | A | 2/2000 | Fujii et al. | |
| 6,138,662 | A | 10/2000 | Jones | |
| 6,827,079 | B2 | 12/2004 | Ahmady | |
| 6,872,070 | B2 | 3/2005 | Moore et al. | |
| 7,104,787 | B2 | 9/2006 | Collier | |
| 7,328,697 | B2 | 2/2008 | Turner et al. | |
| 7,980,850 | B2 | 7/2011 | Abbasi et al. | |
| 8,105,076 | B2 | 1/2012 | Turner et al. | |
| 8,226,405 | B2 | 7/2012 | Dong et al. | |

* cited by examiner

RADIANT HEATER AND COMBUSTION CHAMBER

BACKGROUND

The present disclosure pertains generally to radiant heaters wherein the primary source of heat transferred from the heater to the object being heated is by radiant heat transfer. More particularly, this disclosure pertains to radiant heaters that are designed to heat large areas of buildings with high ceilings. Such areas are typically found in large manufacturing operations, warehouses or logistic areas, hangers for aircraft where maintenance crews may be working, and so forth.

In these types of applications, it is desirable for the heaters to be located at or near the ceiling. Radiant heat, wherein energy is transferred by the emission of light having wavelengths in the infrared to visible regime, transfers energy from the heater unit to surroundings (floors, people, or other objects) by the absorption of these light particles, also called photons, by said surroundings. Unlike the other common modes of heat transfer, convection and conduction, photons travel through air for long distances without substantially heating the air. Convection is a means of transferring energy by heating a fluid, in this case air, followed by the motion of the fluid, and finally the transfer of energy from the heated fluid to a remote object. Conduction is a means of energy transfer whereby the energy flows through a material by electronic vibrations and motions, from a region of higher temperature to a region of lower temperature. Both convection and conduction are inefficient means of transferring energy over large distances, as they require heating the intervening materials.

A primary advantage of radiant heaters is that energy is transferred from the heater to the objects and in close proximity of objects where heat is desired, without having to heat all of the air between the heater and the objects requiring heat. Inevitably, air is heated when it comes in contact with any object that is at a higher temperature than the air. Air that is hotter than the surrounding air will rise towards the top of the air mass. Therefore, the heat transferred from any hot object or heater to the surrounding air will be substantially wasted in a configuration where the heater is near the ceiling of the building to be heated. In fact, only by heating the entire air mass within a building will objects near the floor of the building be heated by contact with the hotter air. Energy that is expended in heating the air near the ceiling of a high-ceilinged structure is substantially wasted with regards to the task of heating people and objects near the floor of the structure.

SUMMARY

A primary goal of the present improved radiant heater is to minimize the transfer of energy from the radiant heater assembly to the surrounding air. The efficiency of the radiant heater can be defined as the fraction of total energy consumed by the heater that is usefully transferred to objects near the floor of the building for which heating was desired. To maximize the efficiency, it is a goal of the radiant heater to both maximize the fraction of energy that is transferred out of the radiant heater via radiation, or photons, as opposed to by convection or conduction, and, it is a goal to maximize the energy that is transferred out of the radiant heater via radiation towards the objects for which heating is intended.

Emission of radiant heat, or energy, from a hot surface is known to be a function of the emissivity of the surface and the temperature of the surface raised to the 4th power. The transfer of energy from one surface to another via the process of radiant heat transfer depends on the emissivity of the each surface, their temperatures, and the solid angle subtended by one surface to the other.

In a radiant heater, the heat created inside the combustion chamber must be transferred out of the chamber which is simply a requirement of the basic physics. The preferred length of the combustion chamber is such that the temperature of the combustion gases that are either drawn out or expelled by an induced or forced draft fan is cooler in comparison to the temperature of the gases where combustion is occurring. Therefore, most of the heat from the combustion is conducted through the walls of the chamber. The outside surfaces of the combustion chamber transfer heat energy by radiation, conduction, or convection.

Previously existing radiant heater designs all utilized combustion chambers that have substantially the same heat conduction from the inside of the chamber to the outside of the chamber in all radial directions along the length of the combustion chamber. This was practical because the most common design was simply a metal tube. Using a radially symmetric tube as a combustion chamber was cost-effective and contained the combustion gases. The good conductivity of the metal minimized the temperature drop from the inside to the outside, so as to maximize the radiant energy emission from the outer surface. However, the radially symmetric tube design made the radiant energy emission radially symmetric from the outside of the tube.

As a result, two detrimental effects occur in the previous designs. First, the emission of radiant energy is equal in all radial directions. Therefore, at least half of the emitted energy initially travels away from the objects and people that are to be heated, including toward the roof of the building for a heater mounted near the ceiling. Second, the total surface area of good conductor on the outside of the combustion chamber and volume are fixed compared with the preferred embodiment of the present radiant heater. Thus, the heat flux per unit area reaching the outside is not optimal, making the temperature lower on the outside for equivalent conducting materials. This reduces the radiant heat emission, which depends on temperature to the 4th power.

Previous radiant heater designs teach a number of ways to attempt to overcome the first deficiency by employing reflectors to redirect the radiant energy emitted towards the roof into useful solid angles. Such designs can be effective at recovering some of the misdirected radiant energy, but all suffer a loss of efficiency. Reflectors are not perfect in the sense that they cannot reflect all radiant energy photons at all wavelengths with equal and very high reflectivity. Because the reflectors absorb some of the energy, they become warm surfaces, not as hot as the outside surface of the combustion tube. Because of the 4th power emission law, the lower temperature reflector surfaces have much reduced efficiency for re-radiating energy they absorb. A second loss of efficiency is that the hot surface area of the combustion tube, including any surface radiating away from the objects to be heated and the area of the warm reflectors, contribute to a much greater heat transfer to the surrounding air by convection. This is very inefficient compared to the much smaller hot surface area of the present radiant heater that is optimally directed towards useful solid angles. The quantity of previous radiant heater designs that depend on optimization of reflectors reinforces the importance and uniqueness of the radiant heater disclosed herein.

The present disclosed radiant heater is comprised of a combustion chamber constructed primarily of two different materials in two different regions, an insulating portion and a conductive portion, each with unique properties to optimize heat transfer from the enclosed flame in a desired direction. The combustion chamber is a long, tubular structure within which combustion occurs. However, the length of the chamber is such that combustion does not occur along the complete length of the chamber. The combustion chamber contains the flames of combustion at the beginning of the chamber and serves to entrain the combustion gases until combustion is complete and the gases have cooled before they exit the end of chamber. The tubular shape of the combustion chamber refers to the fact that the chamber length is long compared with its cross-sectional dimensions, but tubular does not connote or limit the cross-sectional shape to a circle or ellipse in this description.

The insulating portion of the combustion chamber is a good insulator that does not conduct heat efficiently, such as a ceramic material, while the conductive portion is a good heat conductor, such as a metallic material. The outside temperature of the surface of the insulating portion is low compared to the conductive portion. By utilizing a material that is a good insulator, only a small fraction of the total heat energy will be conducted through this region to reach the outer surface. The outside surface of the conductive portion can be treated to have a high emissivity to enhance the radiant energy emission. Examples of these treatments include mechanical surface treatments such as sand blasting, bead blasting, or any media blasting which increases surface area. Chemical treatments include treatments wherein a layer of different chemical properties is created by conversion of the surface to oxides, commonly black oxides with better "black body" properties. Alternatively, a metallic surface layer such as aluminum or plating of a different alloy could be used for the treatment, usually for the purpose of preventing oxidation or rusting of the surface when low carbon lower cost steel is used for the lower temperature return tube. Any suitable treatment for enhancing radiant energy emission can be utilized. The insulating portion together with the conductive portion form an enclosed conduit in which combustion of an air-fuel mixture takes place. The hot gases of combustion can travel through the conduit until the gas temperature drops to a minimum practical level as a result of heat transfer to the surface of the conductive portion.

The nature of radiant energy emission from a surface is such that the shape of the surface will alter the direction and pattern of energy emitted, analogous to how a flashlight can focus the light or a conventional light bulb without a reflector will cast a diffuse light. One unique aspect of the radiant heater is that the shape of the conductive portion's surface can be altered from concave to flat to convex to other variable shapes to modify the radiant energy pattern to suit the application. Similarly the insulating portion of the combustion chamber and hot gas conduit can be shaped to compliment the desired shape of the radiating surface. The two materials can be layered or overlapped, or they can be fitted together in a manner that minimizes overlap. Certain embodiments described herein are directed to configurations of the combustion chamber.

In embodiments of the radiant heater, the volume of the combustion chamber can be modified such that it is larger or smaller while retaining the same radiating surface area. This allows for decreasing the flame and hot gas velocity to optimize heat transfer along the length of the conduit. Additionally, in embodiments of the radiant heater, the insulating portions and conductive portions of the combustion chamber wall need not remain the same along the complete length of the combustion chamber. The walls of the combustion chamber in regions beyond the extent where combustion is occurring, where the internal temperature of the gases is significantly lower, and therefore the total heat transfer through the combustion chamber wall is lower, may have different proportions of insulating circumferential portion to conducting circumferential portion, or even altered cross-sectional shape, as is desired to alter either heat transfer characteristics or costs of the combustion chamber wall materials.

The radiant heater described herein achieves greater heating efficiency than previous radiant heaters used to heat objects or people remote from the heater assembly, particularly when the distance between the heater and the object is very great. Modifying the outside surface of the combustion chamber significantly improves the net efficiency of radiating energy to the desired objects and people. It is important to recognize that the present radiant heater itself radiates heat energy substantially in useful directions compared to previously existing radiant heaters that require reflectors to re-radiate heat energy from combustion chambers that do not radiate heat energy substantially in useful directions.

DETAILED DESCRIPTION OF PREFERRED EMBODIMENTS

The current improved radiant heater design includes a combustion chamber that is made up of a substantially tubular conduit. The conduit is comprised of conduit walls enclosing an inner combustion space. A circumferential portion of the conduit walls extending transversely along the length of the conduit is an insulating portion and a remaining circumferential portion of the conduit walls is a conductive portion. The conducting portion of the conduit walls has a substantially higher external temperature than the external temperature of the insulating portion of the conduit walls when combustion occurs within the inner combustion space, releasing substantial heat energy inside the combustion chamber, and temperatures within the conduit have reached steady-state.

Figure 1:
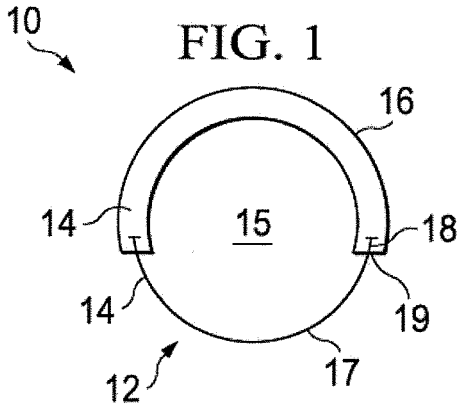
FIG. 1 shows a cross section of a preferred embodiment of a combustion chamber described herein.

Alternate preferred embodiments of a combustion chamber for use in a radiant heater design are illustrated in FIGS. 1-5. FIG. 1 shows a cross section of combustion chamber 10. Combustion chamber 10 is made up of a conduit 12 having a length that is substantially tubular, as better seen in FIG. 6. Conduit walls 14 enclose an inner combustion space 15. Conduit walls 14 are made up of two different circumferential portions that extend transversely along the length of conduit 12. In particular, conduit walls 14 are made up of an insulating portion 16 comprised of a material having reduced heat conduction properties and a conductive portion 17 comprised of a material having enhanced heat conduction properties. In some embodiments, conduit walls 14 are comprised of metal, like a metal tube preferably made of a metal alloy with high operating temperature such as titanium or tantalum, and additional insulating material is affixed to an appropriate circumferential portion of conduit walls 14 to create insulating portion 16. In other embodiments, insulating portion 16 is made entirely of an insulating material such as ceramic and conductive portion 17 is made of metal.

Figure 3:
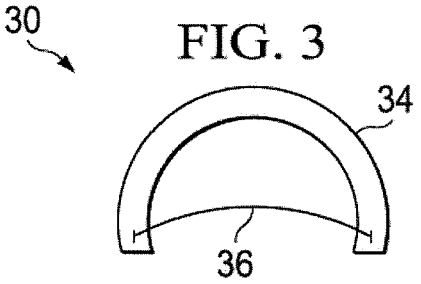
FIG. 3 shows a cross section of a preferred embodiment of a combustion chamber described herein.
Figure 4:
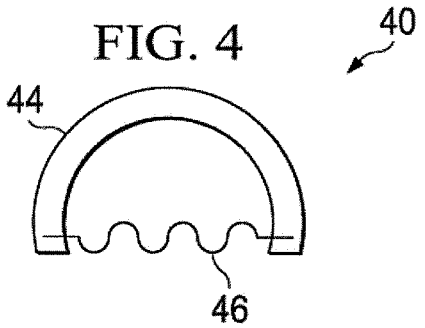
FIG. 4 shows a cross section of a preferred embodiment of a combustion chamber described herein.
Figure 5:
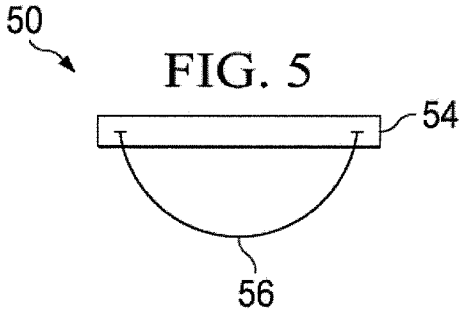
FIG. 5 shows a cross section of a preferred embodiment of a combustion chamber described herein.

Conductive portion 17 may be configured in a variety of shapes to control the direction of heat emission, as seen in FIGS. 1-5. Insulating portion 16 may also be configured in different suitable shapes, as seen in FIGS. 1 and 5. In some embodiments, grooves 19 are included in insulating portion 16 for receiving edges 18 of conductive portion 17, which may be a metal sheet. The edges of the sheet can be curled or bent to slide into grooves 19 to enclose the inner combustion space 15. In certain embodiments, the outer surface of the conductive portion is treated to improve its heat emissivity.

Heating of air or gases within inner combustion space 15 results in a substantial transfer of heat energy to the inner surfaces of conduit 12. Because the heat energy passes more effectively through conductive portion 17 to its outer surface, there is increased radiant heating through conductive portion 17 and reduced radiant heating through insulating portion 16. The increased radiant heating through conductive portion 17 occurs in a desired direction depending on the shape of conductive portion 17 and does not require the use of reflectors, nor does it involve convection or conduction. In FIG. 1, insulating portion 16 is rounded in shape and conductive portion 17 is rounded in shape and positioned in a convex position relative to insulating portion 16. Thus, in FIG. 1, across section of conduit walls 14 is generally shaped like a circle.

Figure 2:
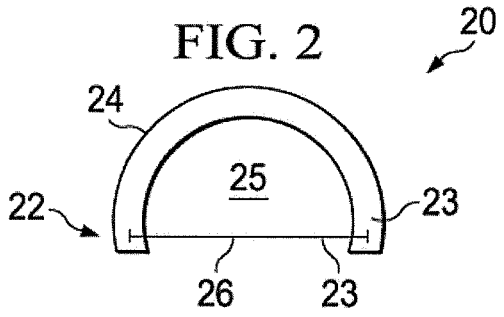
FIG. 2 shows a cross section of a preferred embodiment of a combustion chamber described herein.

FIG. 2 shows a cross section of an alternate embodiment of a combustion chamber 20. Combustion chamber 20 is also made up of a conduit 22 that is substantially tubular and has conduit walls 23 that enclose an inner combustion space 25. Conduit walls 23 are made up of an insulating portion 24 and a conductive portion 26, having the same properties as discussed with regard to FIG. 1. In FIG. 2, insulating portion 24 is rounded in shape and conductive portion 26 is flat. In FIG. 3, in combustion chamber 30, insulating portion 34 is rounded in shape and conductive portion 36 is rounded in shape and positioned in a concave position relative to insulating portion 34. In FIG. 4, in combustion chamber 40, insulating portion 44 is rounded in shape and conductive portion 46 is wavy, or otherwise variable in shape. In another alternate embodiment, in FIG. 5 combustion chamber 50 has an insulating portion 54 that is flat and conductive portion 56 that is rounded.

Figure 6:
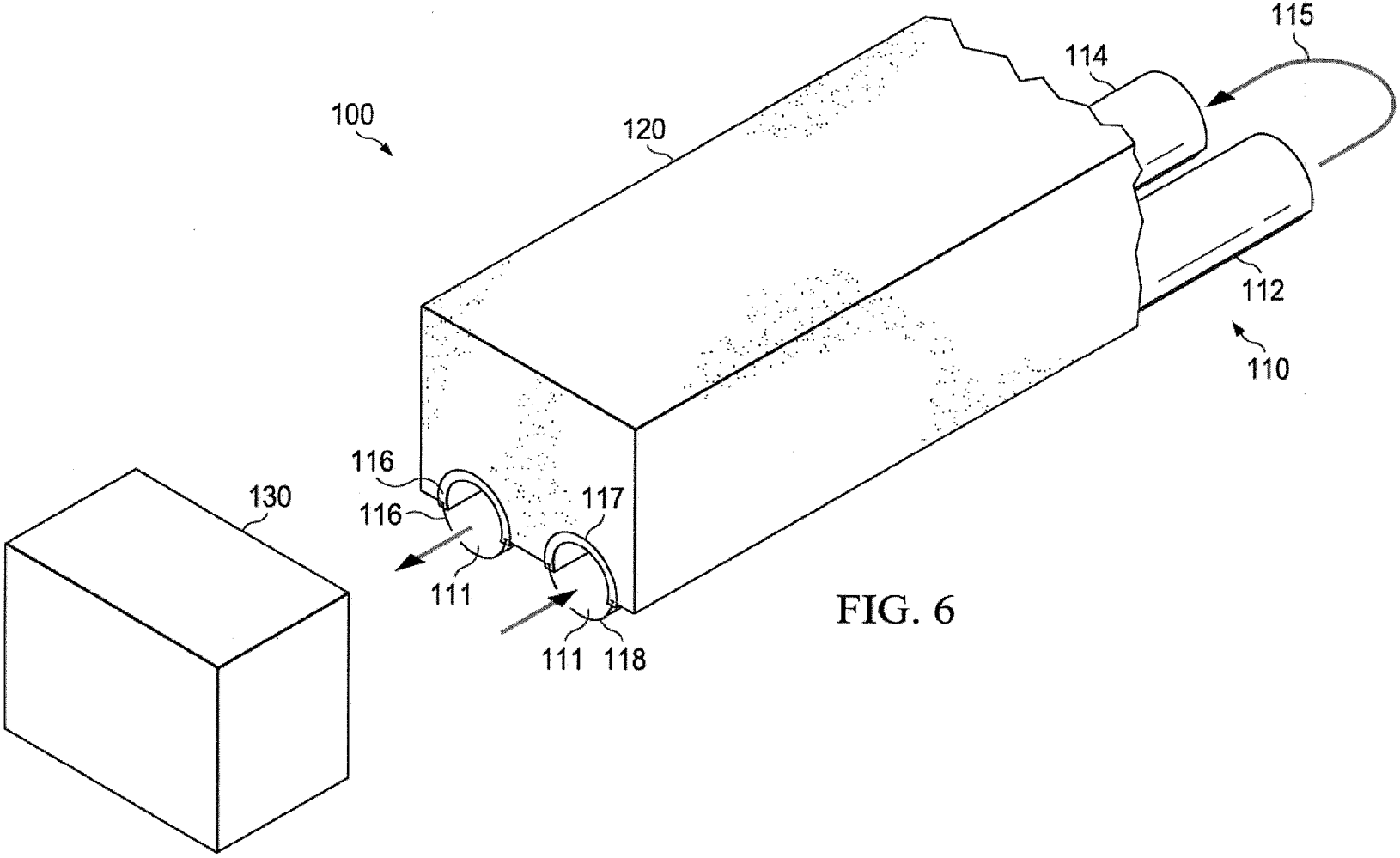
FIG. 6 shows a perspective view of a preferred embodiment of a radiant heater described herein.

An embodiment of a radiant heater 100 is shown in FIG. 6. Radiant heater 100 includes combustion chamber 110, having a substantially tubular length and U shape. In this embodiment of radiant heater 100, combustion chamber 110 is made up of heated conduit branch 112 and cold return conduit branch 114 running substantially parallel to each other. Heated conduit branch 112 and cold return conduit branch 114 are connected by way of a return connection 115. Combustion chamber 110 has conduit walls 116 enclosing an inner combustion space 111 made up of two different circumferential portions that extend transversely along the length of combustion chamber 110. In particular, conduit walls 116 are made up of an insulating portion 117 comprised of a material having reduced heat emitting properties and a conductive portion 118 comprised of a material having enhanced heat emitting properties. The shape of combustion chamber 110 can be configured to resemble any of those embodiments of combustion chambers shown in FIGS. 1-5. As discussed above with regard to FIG. 1, combustion chamber 110 can be made up of a metal tube having additional insulating material affixed to create insulating portion 117, or insulating portion 117 may be entirely made up of an insulating material such as ceramic.

In radiant heater 100, insulating housing 120 surrounds insulating portion 117, while conductive portion 118 is not contacted by insulating housing 120. Radiant heater 100 also includes control box 130. Control box 130 provides heated air or gases into heated conduit branch 112 and receives cooled air or gases from cold return conduit branch 114. Control box 130 may include a burner box to heat air or gas for passage through heated conduit branch 112 and a fan to expel the cooled air or gas by forced or induced draft from cold return conduit branch 114.

The design of radiant heater 100 is such that by the time air or gases return to control box 130 through cold return conduit branch 114, they are completely or nearly completely cooled. Thus, as much heat as possible has passed through conductive portion 118 of combustion chamber 110. Varying the shape, length, and volume of combustion chamber 110 allows for optimization of the radiation pattern, flow rate, and heat transfer.

By way of example, without limitation, one preferred embodiment of a radiant heater uses a conduit 15 to 22 feet in length and uses a D-shaped combustion chamber such as that shown in FIG. 5. In this example, the upper portion of the conduit is the insulating portion and it consists of a ceramic plate containing slots on each side which fix and retain in position the conductive portion, which is a curved metallic radiating surface, below the plate by means of formed lips at each vertical edge. In this example, the insulating housing of the radiant heater contains additional insulation and additional structure needed to support the combustion chamber conduits for their full length. Multiple additional alternate examples of the radiant heater are possible using variations of this design and are all included within the scope of the radiant heater design described herein.

What is claimed is:

1. A radiant heater for use in a building having a ceiling and a floor, comprising:

a combustion chamber having a length that is substantially tubular, wherein the combustion chamber comprises a heated conduit branch and a cold return conduit branch substantially parallel to the heated conduit branch, wherein the combustion chamber is located in the building, wherein the combustion chamber is comprised of conduit walls enclosing an inner combustion space, wherein the conduit walls consist of a metal portion and an insulating portion, wherein an upper partial circumferential portion of the conduit walls extending transversely along the length of the combustion chamber and aligned to direct heat away from the ceiling of the building is the insulating portion and a remaining partial circumferential portion aligned to direct heat toward the floor of the building is a the metal portion, wherein the insulating portion consists entirely of an insulating material, and wherein the combustion chamber lacks reflectors;

an insulating housing surrounding the insulating portion, wherein the insulating housing does not contact the metal portion;

a control box configured to provide heated gas into heated conduit branch and to receive cooled gas from cold return conduit branch, wherein the radiant heater is configured so that a heating of gases in the inner combustion space results in increased radiant heating through the metal portion in toward the floor of the building and away from the ceiling of the building without use of reflectors.

2. The radiant heater of claim 1, wherein the metal portion of the conduit walls is shaped to control direction of radiant heat emission from an outer surface of the metal portion.

3. The radiant heater of claim 2, wherein the insulating portion is rounded in shape and the metal portion is rounded in shape, and wherein the metal portion is positioned in a convex position relative to the insulating portion.

4. The radiant heater of claim 2, wherein the insulating portion is rounded in shape and the metal portion is flat.

5. The radiant heater of claim 2, wherein the insulating portion is rounded in shape and the metal portion is rounded in shape, and wherein the metal portion is positioned in a concave position relative to the insulating portion.

6. The radiant heater of claim 2, wherein the insulating portion is rounded in shape and the metal portion has a corrugated shape.

7. The radiant heater of claim 1, wherein an outer surface of the metal portion is treated to increase heat emitting properties.

8. The radiant heater of claim 1, wherein the metal portion is a metal alloy.

9. The radiant heater of claim 1, wherein the insulating portion is comprised of ceramic.

10. The radiant heater of claim 1, wherein the insulating portion further comprises grooves and wherein edges of the metal portion fit within the grooves to enclose the inner combustion space.

11. The radiant heater of claim 1, wherein the insulating portion is flat and the metal portion is rounded in shape.

12. A method for heating a large space in a building having a ceiling and floor using radiant heating without reflectors, comprising:

passing gas through a radiant heater comprising a combustion chamber having a beginning and an end, wherein the combustion chamber comprises a conduit having a length that is substantially tubular, wherein the combustion chamber comprises a heated conduit branch and a cold return conduit branch substantially parallel to the heated conduit branch, wherein the heated conduit branch and the cold return conduit branch are connected by a return connector, wherein the combustion chamber is located in the building, wherein the combustion chamber lacks reflectors, wherein the conduit is comprised of conduit walls enclosing an inner combustion space, wherein the conduit walls consist of a metal portion and an insulating portion, wherein an upper partial circumferential portion of the conduit walls extending transversely along the length of the conduit and aligned to direct heat away from the ceiling of the building is a the insulating portion and a remaining partial circumferential portion aligned to direct heat toward the floor of the building is a the metal portion, wherein the insulating portion consists entirely of an insulating material, wherein increased radiant heating occurs through the metal portion toward the floor of the building and away from the ceiling of the building without use of reflectors, and wherein the radiant heater further comprises an insulating housing surrounding the insulating portion, wherein the insulating housing does not contact the metal portion, and a control box configured to provide heated gas into heated conduit branch and to receive cooled gas from cold return conduit branch, and wherein combustion occurs at the beginning of the combustion chamber and the heated gas cools as it passes through the length of the conduit; and passing cooled gas through the end of the combustion chamber.

13. The method of claim 12, wherein the metal portion of the conduit walls is shaped to control direction of radiant heat emission from an outer surface of the metal portion.

14. The method of claim 13, wherein the insulating portion is rounded in shape and the metal portion is rounded in shape, and wherein the metal portion is positioned in a convex position relative to the insulating portion.

15. The method of claim 13, wherein the insulating portion is rounded in shape and the metal portion is flat.

16. The method of claim 13, wherein the insulating portion is rounded in shape and the metal portion is rounded in shape, and wherein the metal portion is positioned in a concave position relative to the insulating portion.

17. The method of claim 13, wherein the insulating portion is rounded in shape and the metal portion has a corrugated shape.

18. The method of claim 13, wherein the insulating portion is flat and the metal portion is rounded in shape.

19. The method of claim 12, wherein the insulating portion is comprised of ceramic.

* * * * *